United States Patent [19]

Mora, Jr. et al.

[11] Patent Number: 4,917,419

[45] Date of Patent: Apr. 17, 1990

[54] ELECTROMECHANICAL DOOR LOCK SYSTEM

[76] Inventors: Saturnino F. Mora, Jr., 401 Hidden Vista Dr.; Godofredo A. Jimenez, 448 Windrose Way, both of Chula Vista, Calif. 92010

[21] Appl. No.: 234,553

[22] Filed: Aug. 22, 1988

[51] Int. Cl.[4] ..... F05C 1/04

[52] U.S. Cl. ..... 292/144; 70/279

[58] Field of Search ..... 292/144, DIG. 36, 341.16; 70/279

[56] References Cited

U.S. PATENT DOCUMENTS

| | | | |
|---|---|---|---|
| 580,820 | 4/1897 | Scheeren | 292/144 |
| 608,321 | 8/1898 | Carleton | 292/144 |
| 806,542 | 12/1905 | Hensley | 292/144 |
| 947,866 | 2/1910 | Taylor | 292/144 |
| 1,367,931 | 2/1921 | Varnum . | |
| 1,880,850 | 10/1932 | Dautrick | 292/DIG. 36 |
| 2,717,169 | 9/1955 | Lindbloom | 292/144 |
| 2,786,701 | 3/1957 | Povlich | 292/144 |
| 3,096,815 | 6/1963 | May | 160/188 |
| 3,576,119 | 4/1971 | Harris | 70/271 |
| 3,636,745 | 1/1972 | Green | 292/144 |
| 3,751,086 | 8/1973 | Geringer | 292/144 |
| 3,901,542 | 8/1975 | Salzman et al. | 292/144 |
| 4,038,846 | 8/1977 | Klann | 70/279 |
| 4,254,582 | 3/1981 | McGee | 49/199 |
| 4,557,121 | 12/1985 | Charlton | 70/279 |
| 4,579,376 | 4/1986 | Charlton | 292/144 |
| 4,659,121 | 4/1987 | McGee | 292/144 |

FOREIGN PATENT DOCUMENTS

| | | | |
|---|---|---|---|
| 542554 | 4/1956 | Italy | 292/144 |
| 446103 | 3/1968 | Switzerland | 292/144 |

*Primary Examiner*—Gary L. Smith
*Assistant Examiner*—Eric K. Nicholson
*Attorney, Agent, or Firm*—Brown, Martin, Haller & McClain

[57] ABSTRACT

An electrically operable garage door lock system that employs a block with a bolt to resiliently engage a latch. The block contains a bore to slidably support the bolt. The bolt is connected through a linkage to and is actuated electrically by a solenoid. The door lock has a provision for operation in case of power outages or solenoid failure.

13 Claims, 2 Drawing Sheets

ELECTROMECHANICAL DOOR LOCK SYSTEM

This invention relates generally to an electromechanical door lock system and, more particularly, to a door lock for a lift-type garage door having a latch plate mounted on a door with an aperture for receiving a sliding bolt moved by solenoid actuation. The invention further relates to providing an independent or floating locking pin in an electric door lock which is coupled to a solenoid for actuation.

BACKGROUND OF THE INVENTION

Electrically actuated garage door lock systems for securing a closed garage door are known. Many of these systems are used in conjunction with electrically operated garage door openers. One system for locking an overhead garage door includes a latch mounted on the garage door and a locking assembly mounted on the door frame. The locking assembly uses a solenoid actuated plunger to engage a hole in the latch and lock the door in place. The solenoid can be electrically activated to lock or unlock the door.

In U.S. Pat. No. 4,659,121, a garage door lock system is shown utilizing a plunger mechanism, electrically operated to permit the locking and unlocking of the closed garage door. Similar systems are also shown in U.S. Pat. Nos. 4,254,582 (McGee) and 3,751,086 (Geringer). These designs show a box-like housing for the solenoid-plunger. The plunger, which is used for engaging the latch on the garage door, is shown supported by a pair of plates which form part of the housing for the lock system.

As a means for providing support to the plunger for the engagement of the latch, this system is not always satisfactory. For example, the supporting plates for the bolt are susceptible to buckling when subject to vandalism and tampering, thereby frustrating the objective of providing security in a garage door locking system.

This type of garage door lock system involves the use of an integral solenoid-plunger locking bolt which must be specifically designed and fabricated. For example, design considerations must be given to the compatibility of materials used and the configuration of the overall solenoid-plunger unit. If ruggedness of the bolt or plunger is desired to achieve security, increasing the size of the plunger may be important. This size consideration will affect the construction of the solenoid in that the overall size of the solenoid must also be increased accordingly, since the plunger is integral with the solenoid. In an integral construction, the use of ferrous material within the solenoid further restricts the choice of materials for the plunger/bolt. In the event the solenoid-plunger system becomes inoperative due to, for example, solenoid malfunction, the replacement of the entire unit will become necessary, which is both expensive and inconvenient.

Consequently, there is a need for a new garage door locking system having an independent high security bolt mechanism. There is also a need for a lock system using an uncomplicated actuation system that is readily replaceable in case of failure. In addition, it would be desirable to provide a locking system with high security mounting features.

SUMMARY OF THE INVENTION

This invention provides a garage door lock system comprising a latch plate mountable on the garage door, which has a latch tongue with an opening for receiving a locking bolt. A block is provided which is fastenable to the door frame and has a slot for receiving the latch tongue. A bolt is slidably mounted within a bore in the block for engaging the opening in the tongue of the latch and is normally spring-loaded by a compression spring in the engaged position. An electrically actuated solenoid is used to disengage the bolt from the latch opening for unlocking the door. The solenoid has a plunger connected to the bolt such that their respective axis are non-colinear. The solenoid is connected to the power source for the motor of an overhead electric garage door opener, so that when the motor is energized to open the door, the solenoid will also be energized to disengage the latch tongue from the bolt.

The bolt has an extended portion outside the block to permit manual operation by pulling the bolt away from its engaged position. A retainer is provided to retain the bolt in its disengaged position where locking is not desired.

DESCRIPTION OF THE PREFERRED EMBODIMENT

Figure 1:
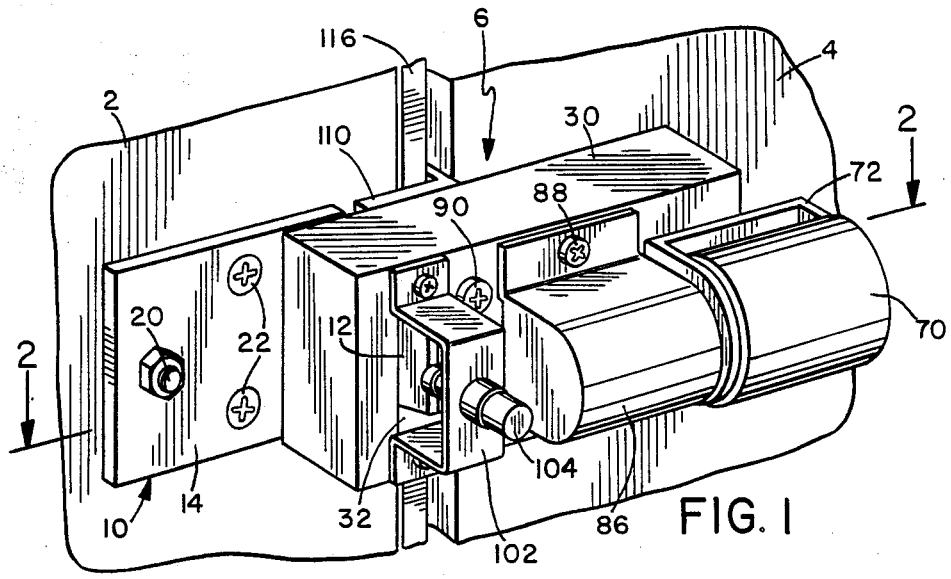
FIG. 1 is a perspective view of the garage door lock.

FIG. 1 shows a garage door lock system 6 which comprises a latch 10 mounted on a garage door 2 and a lock assembly mounted on an adjacent door frame 4. The garage door 2 and door frame 4 are typically made of wood products with 2'×4'or 2'×6'wood members being used for the edge of garage door 2 and door frame 4, respectively. While wood members are used in the illustration of FIG. 1 for purposes of clarity, the present invention is also useful where garage door 2 or door frame 4 comprises plastic or metal materials.

In the preferred embodiment of the invention, latch 10 includes a latch tongue 12 portion, which extends from a flat mounting plate 14 portion used to mount latch 10 to garage door 2. Latch 10 can be constructed of any suitable material having superior structural strength, as known in the art. In the preferred embodiment, a 3/16 inch thick steel plate is used for forming latch 10.

Figure 2:
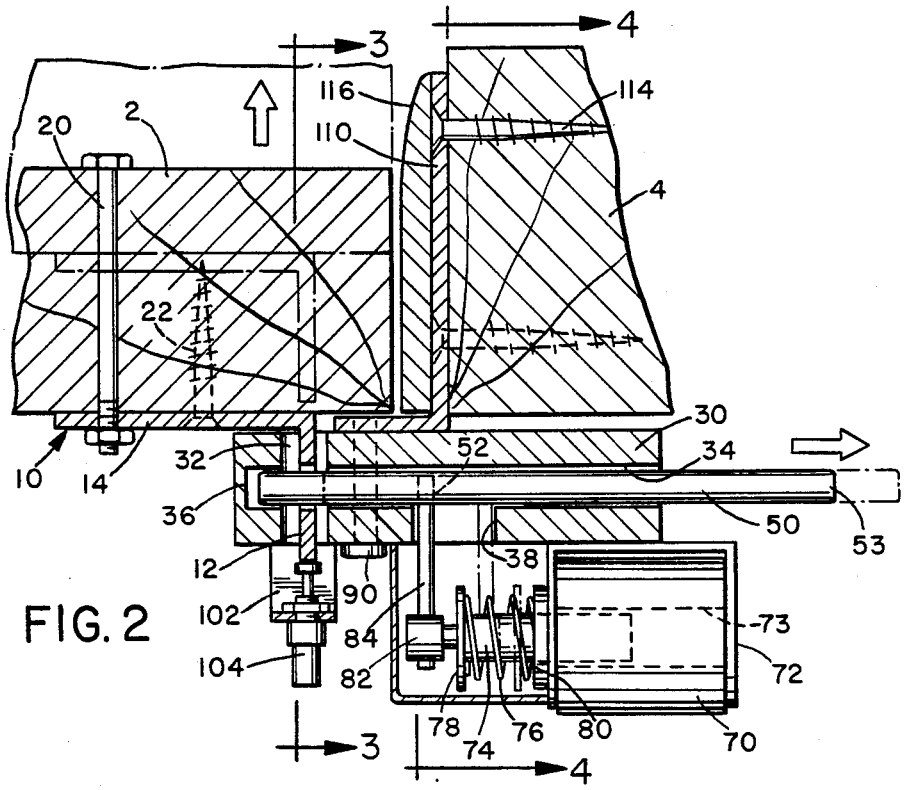
FIG. 2 is a sectional view taken on line 2—2 of FIG. 2.
Figure 3:
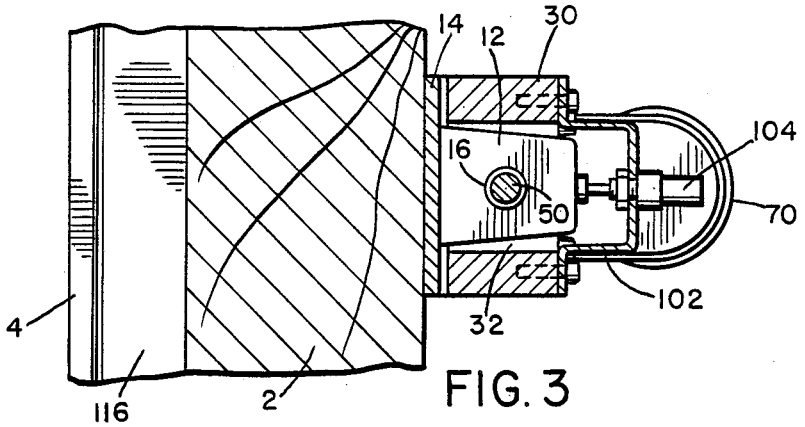
FIG. 3 is a sectional view taken on line 3—3 of FIG. 2.

Latch 10 is mounted in the interior of the garage on garage door 2, preferably a lower corner by a suitable fastening means. As shown in FIGS. 1 and 2, a pair of wood screws 22 and hex bolt and nut 20 can be used for this purpose. To enhance protection, two lock assemblies can be mounted at opposite lower corners of garage door 2.

A mating block 30 is provided, which contains an opening or slot 32 for receiving latch tongue 12. As shown in FIG. 2, block 30 is mounted on door frame 4 such that when garage door 2 is closed latch tongue 12 will be fitted within slot 32.

Slot 32 is wide enough to allow latch tongue 12 to freely move in and out of slot 32 without contact, otherwise, friction could cause excessive wear, binding and jam the door operation. However, slot 32 is made narrow enough to avoid excessive play and movement in the door. Typically, a space on the order of ¼ inch is used between slot 32 and latch tongue 12. Those skilled in the art will readily appreciate the dimensions required for differing materials and applications.

Block 30 has a bolt bore 34 which extends through the length of block 30, parallel to the door, and opens into slot 32. Block 30 is mounted in place, so when garage door 2 is in its closed position bolt bore 34 is axially aligned with aperture 16. A bolt 50 is slidably mounted within bolt bore 34 and is allowed to reciprocate back and forth within bolt bore 34.

For latch engagement, one end of bolt 50 is moved to extend or pass through aperture 16 of latch tongue 12, thus restraining the movement of latch 10 perpendicular to the axis of bolt 50. To further secure latch engagement, a recess 36 is provided on the inner surface of slot 32 opposite to the opening of bolt bore 34. Recess 36 supports or surrounds the end portion of bolt 50 when lock system 6 is locked and latch tongue 12 is engaged. Recess 36 prevents excessive play and provides added security for movement of the extended bolt 50 transverse to its central longitudinal axis.

To unlock the locking system, bolt 50 is retracted from recess 36 and aperture 16 so that it resides within bolt bore 34, and latch tongue 12 is free to exit slot 32 as garage door 2 opens.

Block 30 and bolt 50 can be constructed of any suitable material having sufficient structural strength and rigidity for the desired security application. In one embodiment of the invention, block 30 was constructed of aluminum. However, for some high security applications, steel or hardened steel may prove more useful. Block 30 is generally rectangular in shape for simplicity in construction. Bolt 50 may have different cross-sectional shapes and sizes, however, it is preferably a circular cross-sectional design due to the general availability of low cost materials having circular cross-sections, as well as to the reduced fabrication costs for bolt bore 34. The material used for bolt 50 is generally the same as for sliding bolts found in security locks known in the art. In the preferred embodiment of the invention, the bolt is carbon steel. However, bolt 50 can be made of aluminum for some applications.

Lock assembly 6 is provided with solenoid 70 to electrically operate or actuate bolt 50. Solenoid 70 is typically mounted on block 30 by an appropriate bracket 72 and suitably fasteners, such as screws. Solenoid 70 is of conventional electromagnetic construction using a hollow core, spool shaped, electrically winding structure having an axially extending passage 73. Disposed with passage 73 is a plunger 74, which moves back and forth. Plunger 74 is normally urged outwardly of passage 73 by a compression spring 76 surrounding plunger 74. Compression spring 76 is positioned between a flange 78 affixed at the outward portion of plunger 74 and a seat 80 on bracket 72, and acts against them to resiliently cause plunger 74 to normally remain in its extended position outwardly of passage 73. Solenoid 70 is oriented with passage 73, therefore plunger 74 is parallel to the longitudinal axis of bolt 50.

Figure 4:
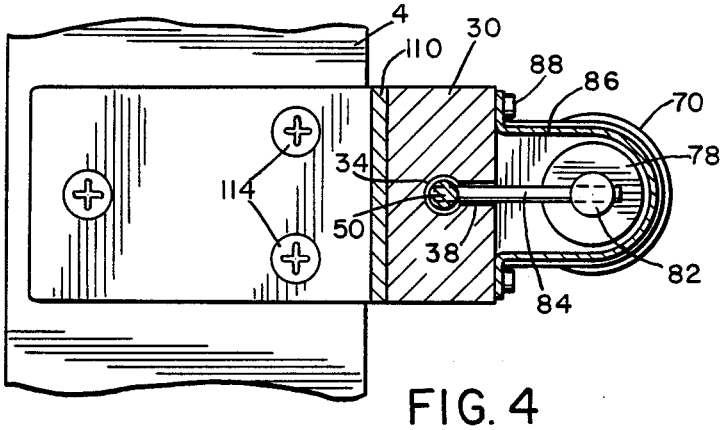
FIG. 4 is a sectional view taken on line 4—4 of FIG. 2.

The outward end of plunger 74 contains an opening slot 81 to accommodate one end of a linkage 84 for connection to bolt 50, as shown in FIG. 4. To reduce any angular movement of linkage 84 with respect to the longitudinal axis of plunger 74 to bolt 50, opening slot has close tolerances for substantially limiting the movement of linkage 84 only to the entry or exit of opening slot 81. A set screw fastened collar 82, having a corresponding opening for fitting the plunger end portion of linkage 84, may be used to secure linkage 84. The opposite end of linkage 84 is engaged within an opening 52 of bolt 50 through a passage 38 of block 30. The dimensions of opening 52 has close tolerances so as to provide a secure fit of a second end portion of linkage 84 into opening 52. Thus, connected linkage 84 enables plunger 74 to directly translate its linear movement to bolt 50 for the engagement or disengagement of latch 10.

A cover 86, mounted on block 30 by a pair of screws 88, is provided for shielding the moving parts, such as the plunger 74, spring 76 and the linkage 84 from any unwanted interference.

Figure 5:
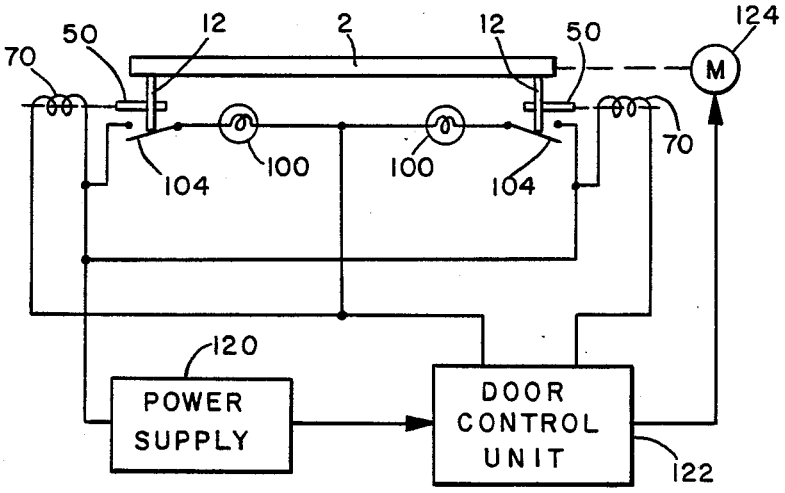
FIG. 5 is a diagram of the electrical door control system.

As in any conventional solenoid, plunger 74 is generally of ferrous material and magnetized. In the preferred embodiment of the invention, the magnetic orientation of plunger 74 is such that when solenoid 70 is energized, plunger 74 will retract into passage 73. Solenoid 70 may be electrically connected to a power source in the garage or building using garage door 2 for access. Where lock system 6 is used in conjunction with an overhead garage door opener, the solenoid is preferably electrically connected to the power supply used for the actuation of the door opener motor, as schematically shown in FIG. 5.

Lock system 6 has provisions for the manual disengagement of latch 10, which may be necessary if electrical power is unavailable or if solenoid 70 is inoperative. In the preferred embodiment, this is made feasible by having the axial length of bolt 50 sufficiently long, such that when latch 10 is engaged bolt 50 extends outside block 30. When manual disengagement of latch 10 is desired, the extended end portion 53 is simply manually moved so that bolt 50 retracts from slot 32.

To retain bolt 50 in its retracted position, a retaining device (not shown) can be employed at the extended end 53 of bolt 50, so as to prevent bolt 50 from moving back into bolt bore 34.

The lock assembly is securably mounted on door frame 4 by a bracket 110, which comprises two mounting surfaces perpendicular to each other, as shown in FIGS. 2 and 4. The first mounting surface is used for mounting a supporting block 30 and solenoid 70 by a bolt 90. The second mounting surface is located in a clearance area between garage door 2 and door frame 4 where it is butt-mounted on door frame 4 by appropriate fasteners, such as screws 114 entering into door frame 4 in a direction perpendicular to the movement of garage door 2.

Screws 114 are longer than the clearance space or separation between garage door 2 and door frame 4 when the door is closed. Thus, the removal of screws 114 is generally prevented when garage door 2 is closed. This mounting approach therefore reduces access, through which unauthorized persons or vandals may attempt to tamper with the lock system.

To enhance alignment of latch 10 with slot 32 on block 30, a door guide 116 is also provided, as shown in FIG. 2. Door guide 116 is located within the door clearance space and is mounted by suitable means, for example, fastening screws or other type of attachment device to either the bracket 110 or directly to the door frame 4. This configuration further serves to provide a barrier against unwanted access to the lock assembly.

In the embodiment, the lock system is electrically connected to the power supply 120 and door control unit 122 of an electric garage door opener as shown in FIG. 5. The electric garage door opener is generally available and can be of either the screw drive or chain drive type. The power unit 120 obtains its power from a house current (not shown) and supplies electricity to the door opener motor 124 through the door control unit 122. Solenoid 70 is connected to the door control unit 122 at the connecting junctions where motor 124 is connected. This ensures that both the motor 124 and solenoid will operate at the same time when the former is actuated.

In the preferred embodiment, the lock system is provided with an indicator light 100 which can be mounted either inside or outside of the garage. Indicator light 100 is operated by a switch 104 which is connected to the power control unit of the garage door opener, as schematically shown in FIG. 5. Switch 104 is engaged in the opened position by latch tongue 12 of latch 10 while in slot 32. Thus, when latch 10 is engaged by bolt 50, indicator light 100 is electrically disconnected. When latch tongue 12 exits slot 32, switch 104 is closed and indicator light 100 is turned on.

The foregoing description and drawings were given for illustrative purposes only, it being understood that the invention is not limited to the embodiments disclosed, but is intended to embrace any and all alternatives, equivalents, modifications, and rearrangements of elements falling within the scope of the inventions defined by the following claims.

I claim.

1. A garage door lock system for locking a garage door to a door frame comprising:

a latch mountable on a garage door, said latch having a tongue with a bolt aperture opening through said tongue;

a block of solid material fastenable to said door frame, said block having an elongate bolt bore extending into said solid material and a tongue slot, said bolt bore opening into said slot;

a bolt slidably mounted within said bore, said bolt being movable to a first portion extending into said slot and a second position retracted from said bolt aperture and into said bolt bore;

a solenoid mounted on said block, said solenoid including a plunger, said plunger being movable by said solenoid between a first extended position and a second energized position, said plunger being non-colinear with said bolt; and a coupling mechanism connected between said plunger and said bolt for causing said bolt to move between said first and second positions.

2. The garage door lock system according to claim 1 wherein said bolt has an extended portion outside said block for manually moving said bolt to said second retracted position.

3. The garage door lock system according to claim 1 wherein said lock system further comprises resilient means to urge said bolt to said first extended position.

4. The garage door lock system according to claim 3 wherein said resilient means includes a compression spring.

5. The garage door lock system according to claim 1 wherein said lock system further comprises resilient means to urge said plunger to said first extended position.

6. The garage door lock system according to claim 5 wherein said resilient means comprises a compression spring.

7. The garage door lock system according to claim 6 wherein said compression spring is disposed surrounding said plunger.

8. The garage door lock system according to claim 1 wherein said lock system further comprises means for mounting said block in a direction traversing the movement of said door.

9. The garage door lock system according to claim 1 wherein said lock system further comprises an indicating light for confirming the operation of said lock system.

10. The garage door lock system as claimed in claim 8, wherein said mounting means comprises a mounting bracket having two perpendicular arms, first securing means for securing a first one of said arms to said solid housing and second securing means for securing the second of said arms to said door frame in a gap between said door frame and said garage door.

11. The garage door lock system as claimed in claim 10, wherein said second securing means comprises a plurality of screw fasteners for extending transverse to said second arm into said door frame in a direction perpendicular to the movement of said garage door, said fasteners being longer than the gap between said frame and garage door.

12. The garage door lock system as claimed in claim 10, wherein said second arm includes a guide surface extending in the direction of movement of said garage door for guiding a side edge of said garage door relative to said block to align said tongue relative to said slot.

13. The garage door lock system as claimed in claim 12, wherein said guide surface has a tapered leading edge.

* * * * *